US012366030B2

(12) United States Patent
Borgerson et al.

(10) Patent No.: US 12,366,030 B2
(45) Date of Patent: Jul. 22, 2025

(54) LAUNDRY MACHINE

(71) Applicant: WHIRLPOOL CORPORATION, Benton Harbor, MI (US)

(72) Inventors: Matthew Borgerson, St. Joseph, MI (US); Dino Bucci, Castelplanio (IT); Andreyson Jambersi, Araras (BR); Mario A Goncalves, Stevensville, MI (US); Pushpendra Mahajan, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 571 days.

(21) Appl. No.: 17/858,344

(22) Filed: Jul. 6, 2022

(65) Prior Publication Data

US 2024/0011218 A1 Jan. 11, 2024

(51) Int. Cl.

| | |
|---|---|
| ***D06F 58/52*** | (2020.01) |
| ***D06F 58/02*** | (2006.01) |
| ***D06F 58/20*** | (2006.01) |

(52) U.S. Cl.

CPC ..... *D06F 58/52* (2020.02); *D06F 58/02* (2013.01); *D06F 58/20* (2013.01)

(58) Field of Classification Search

CPC ..... D06F 58/02; D06F 58/20; D06F 58/52

USPC ..... 34/130

See application file for complete search history.

(56) References Cited

U.S. PATENT DOCUMENTS

| | | | | |
|---|---|---|---|---|
| 3,269,690 | A * | 8/1966 | Rothenberger | E02B 13/02 251/204 |
| 5,768,730 | A | 6/1998 | Matsumoto et al. | |
| 8,667,702 | B2 | 3/2014 | Ediger et al. | |
| 8,888,574 | B2 | 11/2014 | Bredahl et al. | |
| 9,719,205 | B2 * | 8/2017 | Kasapoglu | F04D 29/664 |
| 10,590,592 | B2 | 3/2020 | Lee et al. | |
| 10,927,550 | B1 | 2/2021 | Cline et al. | |
| 2019/0338741 | A1 * | 11/2019 | Fletcher | F16K 3/30 |
| 2020/0362500 | A1 * | 11/2020 | Abbott | D06F 33/00 |
| 2024/0093421 | A1 * | 3/2024 | Borgerson | D06F 58/04 |

FOREIGN PATENT DOCUMENTS

| | | | |
|---|---|---|---|
| DE | 102010031268 | A1 | 1/2012 |
| EP | 2772581 | B1 | 3/2014 |
| WO | 2007065831 | A1 | 6/2007 |

* cited by examiner

*Primary Examiner* — Connor J Tremarche

(74) *Attorney, Agent, or Firm* — Brooks Kushman P.C.

(57) ABSTRACT

A clothes dryer includes a housing, a fan, and a sound blocker. The housing defines an internal cavity and an orifice. The fan is configured to direct air through the internal cavity. The sound blocker is disposed within the cavity and is configured to linearly slide between a first position and a second position. In the first position, the sound blocker is disposed over the orifice to obstruct fluid communication between the internal cavity and the exterior of the cabinet via the orifice, and to reduce noise emitted through the orifice. In the second position, the sound blocker is retracted away from the orifice to allow fluid communication between the internal cavity and the exterior of the cabinet via the orifice.

20 Claims, 6 Drawing Sheets

LAUNDRY MACHINE

TECHNICAL FIELD

The present disclosure generally relates to laundry treating appliances such as a laundry dryer or washing machine.

BACKGROUND

Laundry appliances, such as clothes washers, dryers, refreshers, and non-aqueous systems, may include a rotating drum (or basket) for receiving items to be laundered or dried. The drum is housed in an appliance body, where the body has a door for providing access to the drum.

SUMMARY

A heat-pump type clothes dryer includes a cabinet, a drum, a heat exchanger, a fan, and a sound blocking plate. The cabinet defines an internal cavity and an orifice. The orifice establishes fluid communication between the internal cavity and an exterior of the cabinet. The drum is disposed within the internal cavity and is configured to receive clothing articles. The heat exchanger is disposed within the internal cavity and is configured heat the internal cavity to dry the clothing articles. The fan is configured to exhaust air from the internal cavity to the exterior of the cabinet via the orifice. The sound blocking plate is disposed within the cavity and is configured to linearly slide between a first position and a second position. In the first position, the sound blocking plate is disposed over the orifice to obstruct fluid communication between the internal cavity and the exterior of the cabinet, and to reduce noise emitted from the internal cavity to the exterior of the cabinet via the orifice. In the second position, the sound blocking plate is retracted away from the orifice to allow fluid communication between the internal cavity and the exterior of the cabinet via the orifice.

A clothes dryer includes a housing, a fan, and a sound blocker. The housing defines an internal cavity and an orifice. The fan is configured to direct air through the internal cavity. The sound blocker is disposed within the cavity and is configured to linearly slide between a first position and a second position. In the first position, the sound blocker is disposed over the orifice to obstruct fluid communication between the internal cavity and an exterior of the housing via the orifice, and to reduce noise emitted through the orifice. In the second position, the sound blocker is retracted away from the orifice to allow fluid communication between the internal cavity and the exterior of the housing via the orifice.

A clothes dryer includes a housing, a fan, a plate, and a controller. The housing defines an internal cavity and an orifice. The fan is configured to exhaust air from the internal cavity via the orifice. The plate is disposed within the cavity and is configured to linearly slide between a first position and a second position. In the first position, the plate is disposed over the orifice to obstruct fluid communication between the internal cavity and an exterior of the housing via the orifice, and to reduce noise emitted through the orifice. In the second position, the plate is retracted away from the orifice to allow fluid communication between the internal cavity and the exterior of the housing via the orifice. The controller is programmed to, in response to an absence of a command to exhaust air from the internal cavity via the orifice, shutdown the fan and transition the plate to the first position. The controller is further programmed to, in response to the command to exhaust air from the internal cavity via the orifice, activate the fan and transition the plate to the second position.

DETAILED DESCRIPTION

Figure 1:
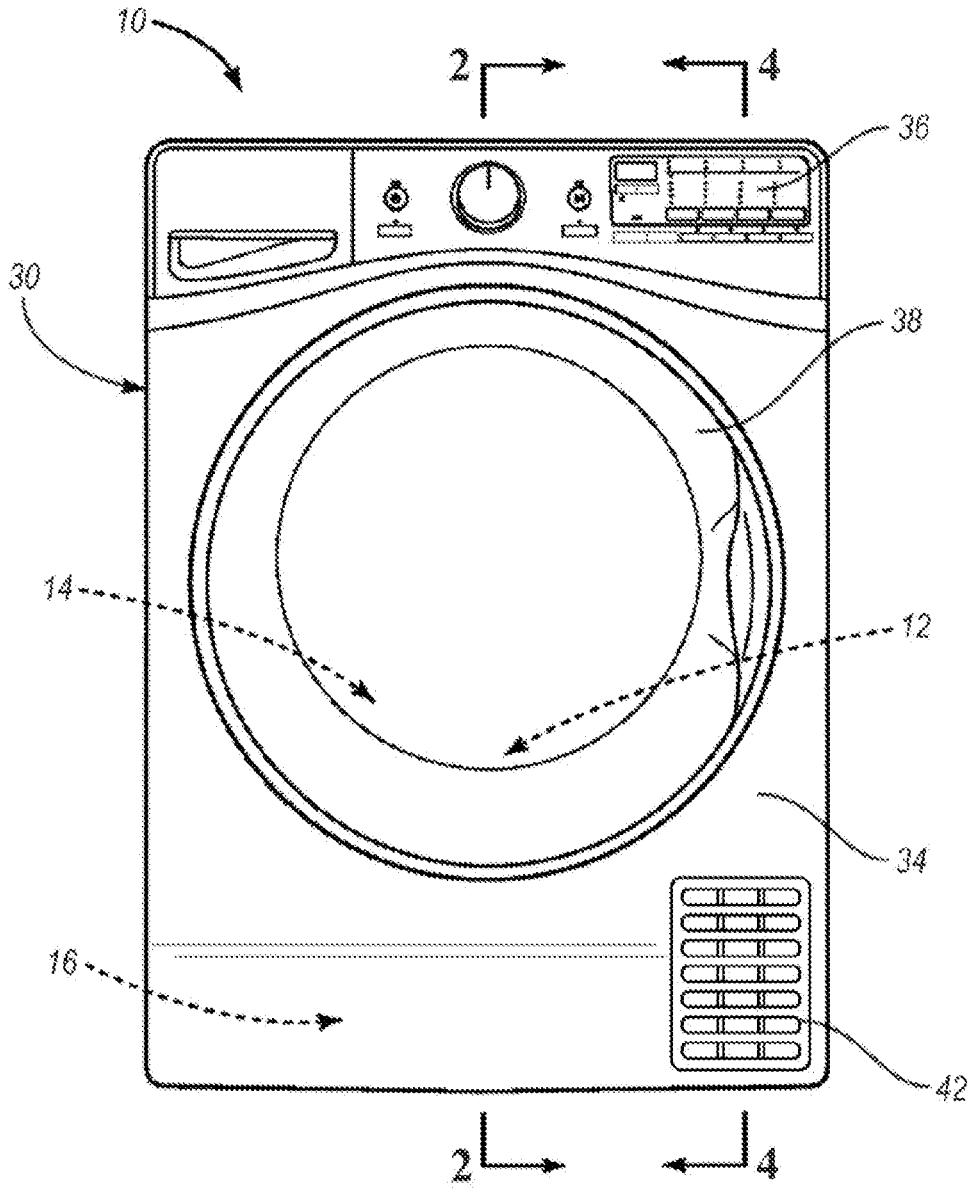
FIG. 1 is a front view of a laundry treating appliance in the form of a clothes dryer.
Figure 2:
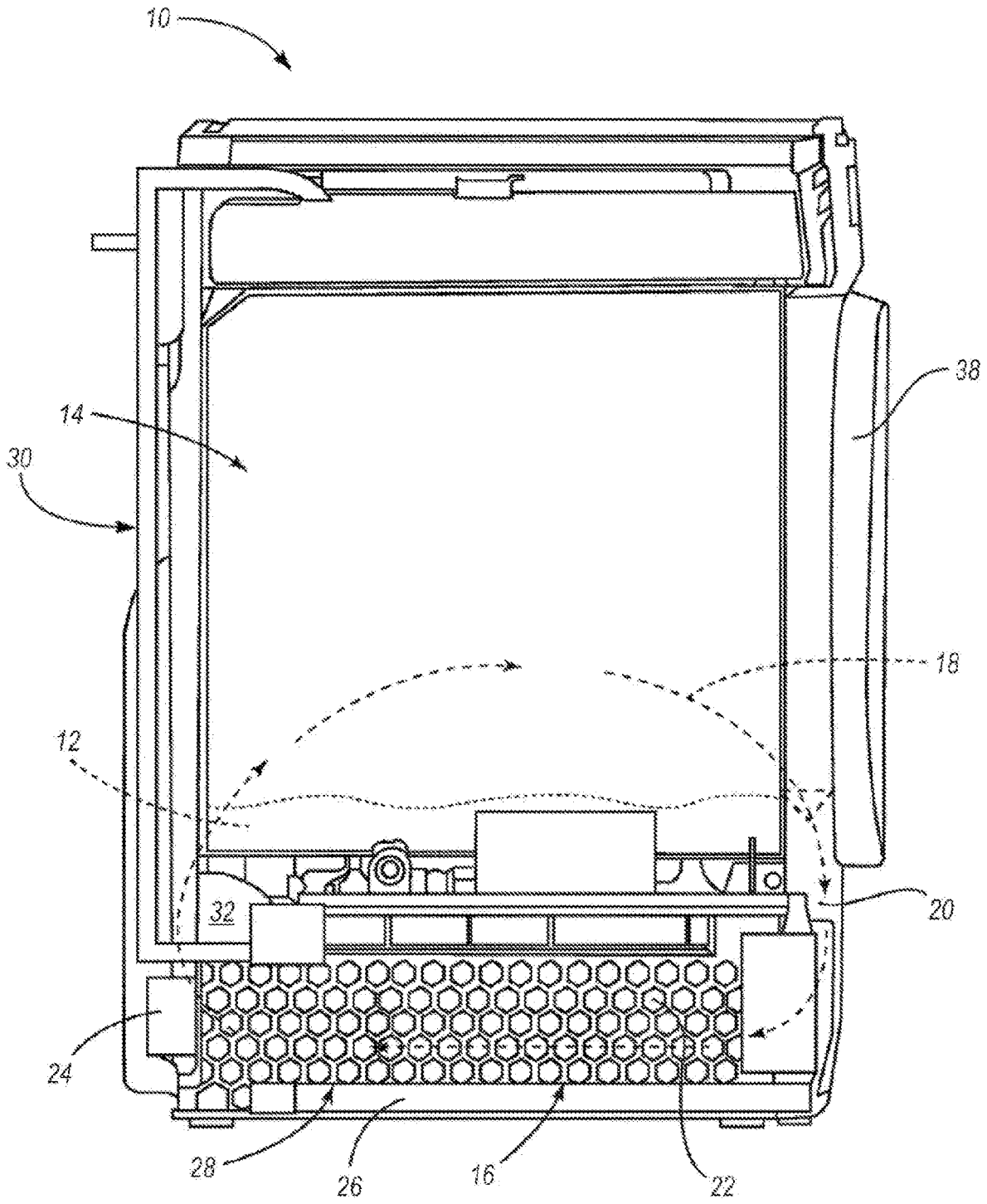
FIG. 2 is a cross-sectional view of the laundry treating appliance taken along line 2-2 in FIG. 1.
Figure 3:
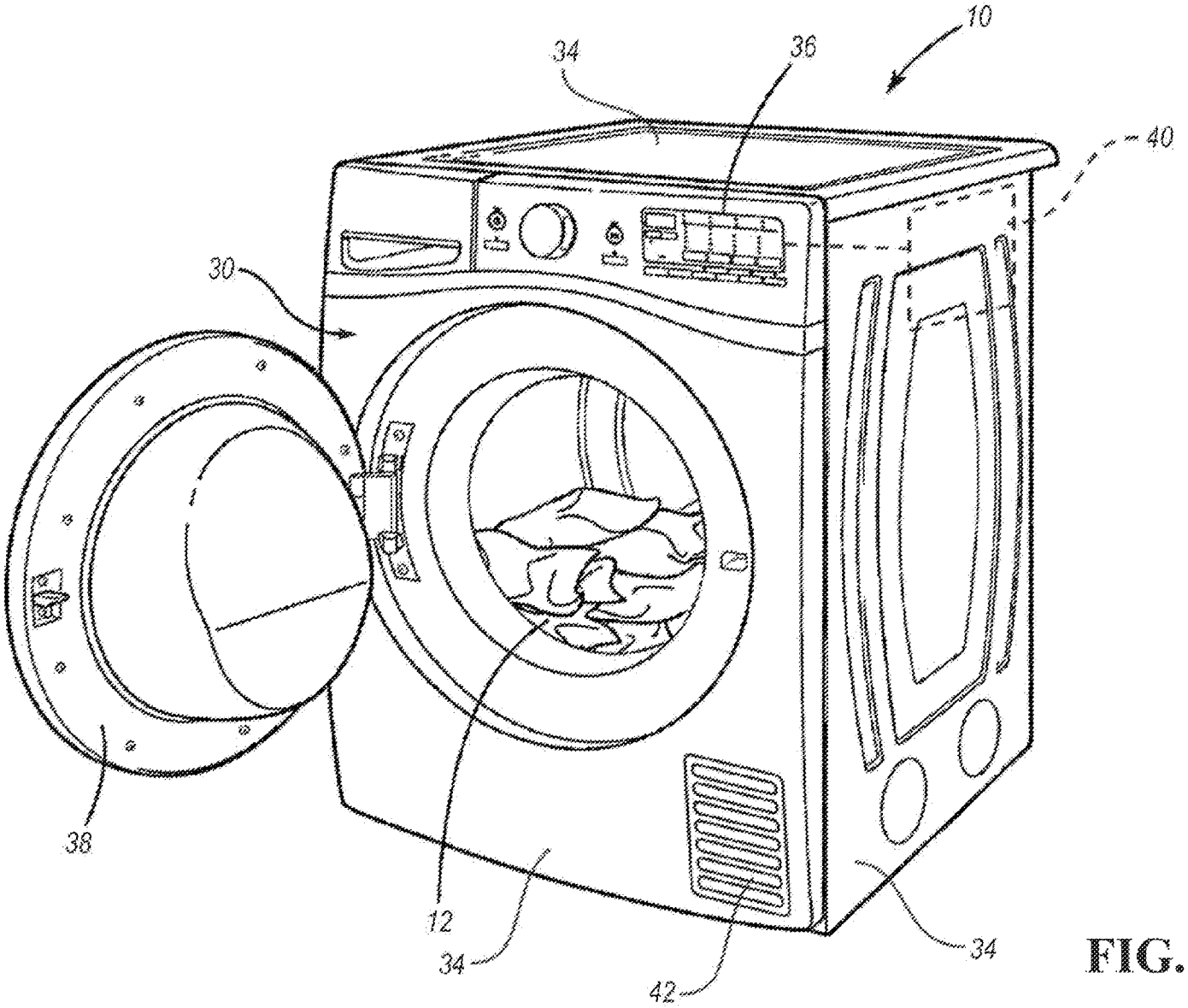
FIG. 3 is a front isometric view of the laundry treating appliance.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Referring to FIGS. 1-4, a laundry appliance 10 for processing clothing articles or laundry 12 is illustrated. The appliance 10 includes a drum 14 that is configured to receive the clothing articles or laundry 12. In some embodiments, the appliance 10 may be a laundry drying appliance. To assist in processing the laundry 12 within the drum 14, a heat pump system 16 can be configured to condition process air 18 that is moved through an airflow path 20. The heat pump system 16 may include one or more heat exchangers 22, which may be in the form of an evaporator and a condenser. The heat exchangers 22, in the form of evaporators, may be configured to dehumidify process air 18 that is delivered from the drum 14. The process air 18 delivered from the drum 14 can include moisture and lint particles that are carried away from the load of laundry 12 and are moved by a fan or blower 24 through the airflow path 20 to the heat exchangers 22. The heat exchangers 22, in the form of condensers, of the heat pump system 16 can reject heat from a surface of the condenser and deliver this heat into the process air 18. The process air 18 may thereby be heated and then delivered back to the drum 14 for continuing the processing of the laundry 12. The blower 24 of the laundry drying appliance 10 can deliver process air 18 through the airflow path 20 that includes the rotating drum 14 and the various heat exchangers 22 of the heat pump system 16.

During the performance of a particular drying cycle, moisture can be removed from the load of laundry 12 and moved to the heat exchangers 22 where the removed moisture can form condensation that may be captured within a drain channel 26 of the laundry drying appliance 10. Additionally, various other residual fluids 28, including moisture, water vapor, and condensation in the drain channel 26, can be captured or otherwise deposited within portions of the airflow path 20 and can remain within the airflow path 20 after completion of the drying cycle. It should be appreciated that in alternative embodiments, a washing machine or a combination washing machine/dryer may be used without departing from the teachings herein.

The appliance 10 is shown with a load of laundry 12 disposed therein. The appliance 10 has a housing or cabinet 30 defining an internal cavity 32. The cabinet 30 may more specifically having a plurality of interconnected panels or walls 34 that define the internal cavity 32. The interconnected panels or walls 34 may include a top wall, a bottom wall, a front wall, a back wall, and two side walls. The drum 14 and the heat pump system 16, including the heat exchangers 22, may be disposed within the internal cavity 32. Therefore, the heat exchangers 22 in the form of evaporators, may more specifically be configured to the dehumidify the process air 18 that is flowing through the internal cavity 32 and away from the drum 14, while the heat exchangers 22, in the form of condensers, may more specifically be configured to deliver heat to the process air 18 that is flowing through the internal cavity 32 and to the drum 14.

The appliance 10 may have a control panel 36 configured to operate the appliance 10. It should be appreciated that the appliance 10 may be a washing machine, dryer, or other appliance that may utilize washing, drying, and/or sanitation processes without departing from the teachings herein. The appliance 10 includes a door 38. The door 38 may be closed and a selected cycle may be started via engaging the control panel 36. A controller 40 receiving signals from the control panel 36 and various sensors may activate and control the appliance through washing, drying, and/or sanitation cycles.

While illustrated as one controller, the controller 40 may be part of a larger control system and may be controlled by various other controllers throughout the appliance 10. It should therefore be understood that the controller 40 and one or more other controllers can collectively be referred to as a "controller" that controls various actuators in response to signals from various sensors to control functions the appliance 10. The controller 40 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 40 in controlling the appliance 10.

Control logic or functions performed by the controller 40 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller, such as controller 40. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

Figure 4:
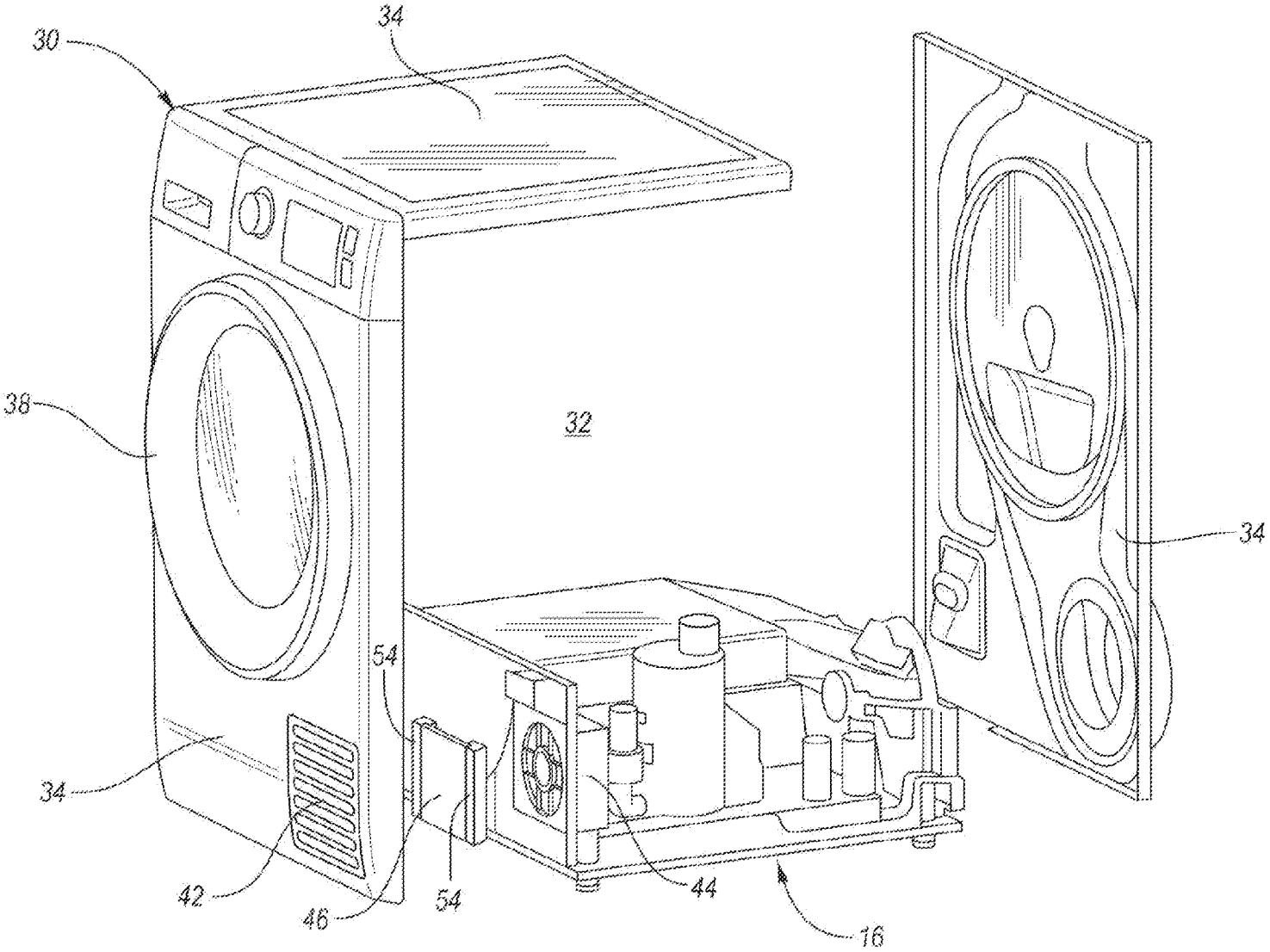
FIG. 4 is an exploded cross-sectional isometric view of the laundry treating appliance taken along line 4-4 in FIG. 1 with the drum of the laundry treating appliance removed.
Figure 5:
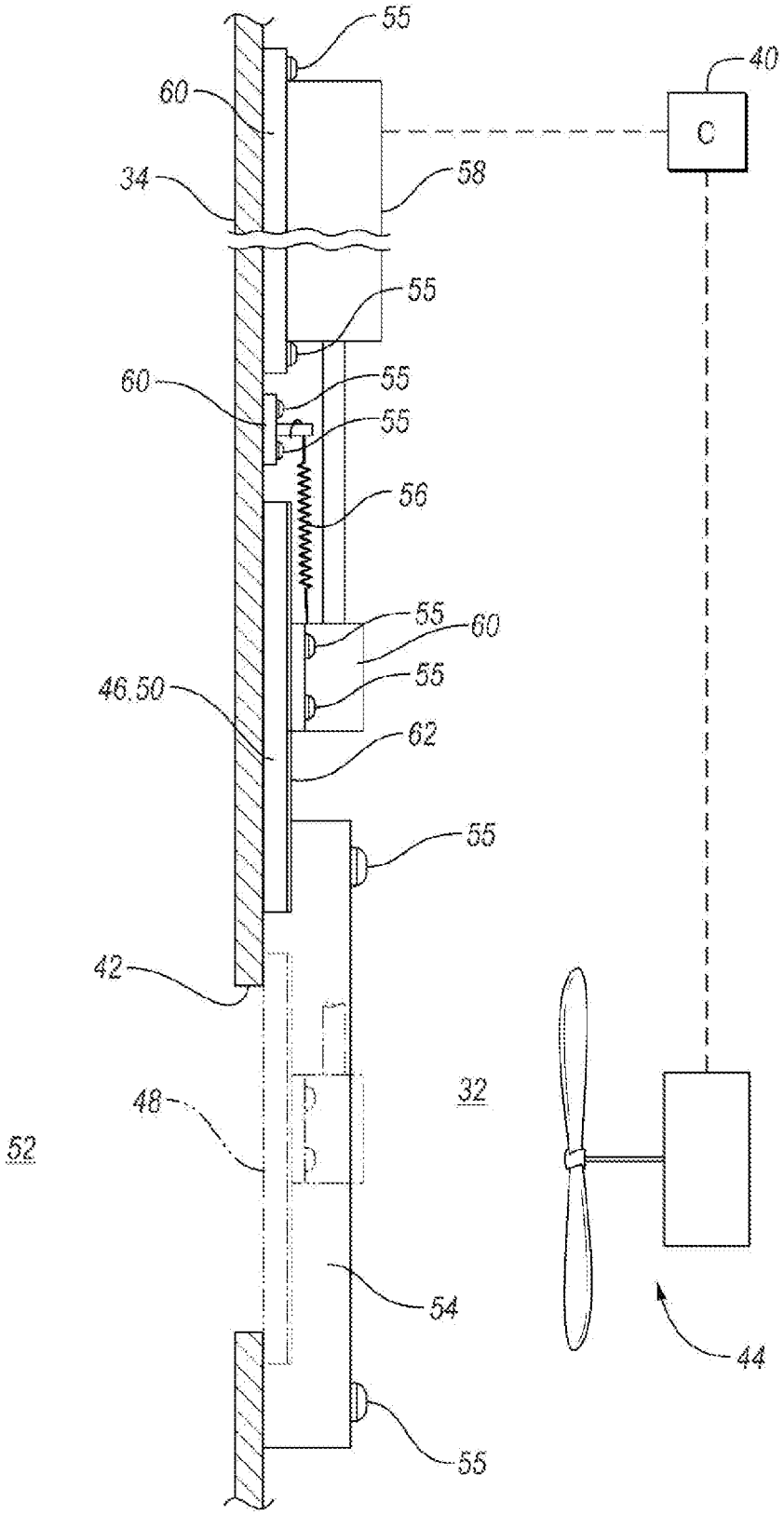
FIG. 5 is side view of a sound blocking device.

Referring now to FIGS. 4 and 5, the cabinet 30, or more specifically one of the walls 34, may define an orifice 42 that establishes fluid communication between the internal cavity 32 and an exterior 52 of the cabinet 30. The orifice 42 may or may not be grated. The appliance 10 may also include an auxiliary fan 44. The auxiliary fan 44 may be an exhaust fan that directs air from the internal cavity 32 to the exterior 52 of the cabinet 30 via the orifice 42 or may be an intake fan that directs air from the exterior 52 of the cabinet 30 to the internal cavity 32 via the orifice 42. The auxiliary fan 44 may be in communication with and operated by the controller 40. The drum 14 and the two side walls 34 have been removed in FIG. 4 for illustrative purposes.

The appliance 10 may further include a sound blocker 46. The sound blocker 46 may be in the form of a plate. The wall 34 is illustrated in cross-section in FIG. 5 so that the orifice 42 may be viewed in relation to the sound blocker 46 and the other components associated with the sound blocker 46. The sound blocker 46 is disposed within the internal cavity 32. The sound blocker 46 is configured to linearly slide between a first position 48 and a second position 50. The sound blocker 46 is disposed over the orifice 42 to obstruct fluid communication between the internal cavity 32 and the exterior 52 of the cabinet 30 via the orifice 42, and to reduce noise emitted from the internal cavity 32 to the exterior 52 of the cabinet 30 via the orifice 42 when the sound blocker 46 is in the first position 48. The sound blocker 46 is retracted away from the orifice 42 to allow fluid communication between the internal cavity 32 and the exterior 52 of the cabinet 30 via the orifice 42 when the sound blocker 46 is in the second position 50.

The sound blocker 46 may be adjacent to and not spaced apart from the orifice 42 when in the first position 48. One or more rails 54 may be configured to linearly guide the sound blocker 46 between the first position 48 and the second position 50. The one or more rails 54 may be anchored to one of the walls 34 via fasteners 55. A spring 56 may be configured to bias the sound blocker 46 toward the second position 50. The spring 56 may be anchored to both the sound blocker 46 and to one of the walls 34 via fasteners 55. An actuator 58 may be configured to transition the sound blocker 46 between the first position 48 and the second position 50. The actuator 58 may be slidably connected to the sound blocker 46 and may be anchored to one of the walls 34 via fasteners 55. The actuator 58 is shown as broken in FIG. 5 to illustrate that the actual size of the actuator may be different that what is illustrated.

The spring 56 and actuator 58 may more specifically be connected to one of the walls 34 and to the sound blocker 46 via adapter plates or blocks 60. The adapter plates or blocks 60 may in turn be connected to one of the walls 34 and to the sound blocker 46 via the fasteners 55. The actuator may be any type of linear actuator (e.g., a linear electric motor, an electric solenoid, a hydraulic cylinder operated by an electric valve, or a pneumatic cylinder operated by an electric valve). The actuator 58 may be in communication with and operated by the controller 40.

A sound proofing material 62 may be disposed on the sound blocker 46 to further reduce noise emitted from the internal cavity 32 to the exterior 52 of the cabinet 30 via the orifice 42. Such noise may be generated by the moving components disposed with the internal cavity 32, such as, but not limited to the drum 14, a motor that turns the drum 14, a compressor or other moving component of the heat pump system 16, the blower 24, etc. The sound proofing material 62 may more specifically be disposed on the interior side of the sound blocker 46 and on an opposing side of the orifice 42. The sound proofing material 62 may be a coating that is disposed on the sound blocker 46 or may encompass the entirety of the sound blocker 46. The sound proofing material 62 may be any material that is known to reduce noise, such as, but not limited to a silicone or rubber material.

The sound blocker 46 is illustrated to move up and down between the first position 48 and the second position 50. However, the components may be rearranged such that the sound blocker 46 moves side to side between the first position 48 and the second position 50. Alternatively, the sound blocker may move in a fore and aft direction relative to the orifice 42. For example, with reference to FIG. 5, the sound blocker 46 may be adjustable between an engaged position that corresponds to the first position 48 and a disengaged position that is to the right of the first position 48. In such an alternative, the spring 56 and the actuator 58 may be reoriented 90° clockwise with respect to what is illustrated in FIG. 5, and the anchoring positions of the spring 56 and the actuator 58 would be adjusted for their respective new positions. The rails 54 may also be reoriented and may require and design adjustment in such an alternative. For example, the rails 54 may define a slot that engages protrusions or pegs that extend from the sound blocker 46 to guide the sound blocker 46 between the engaged and disengaged position.

Figure 6:
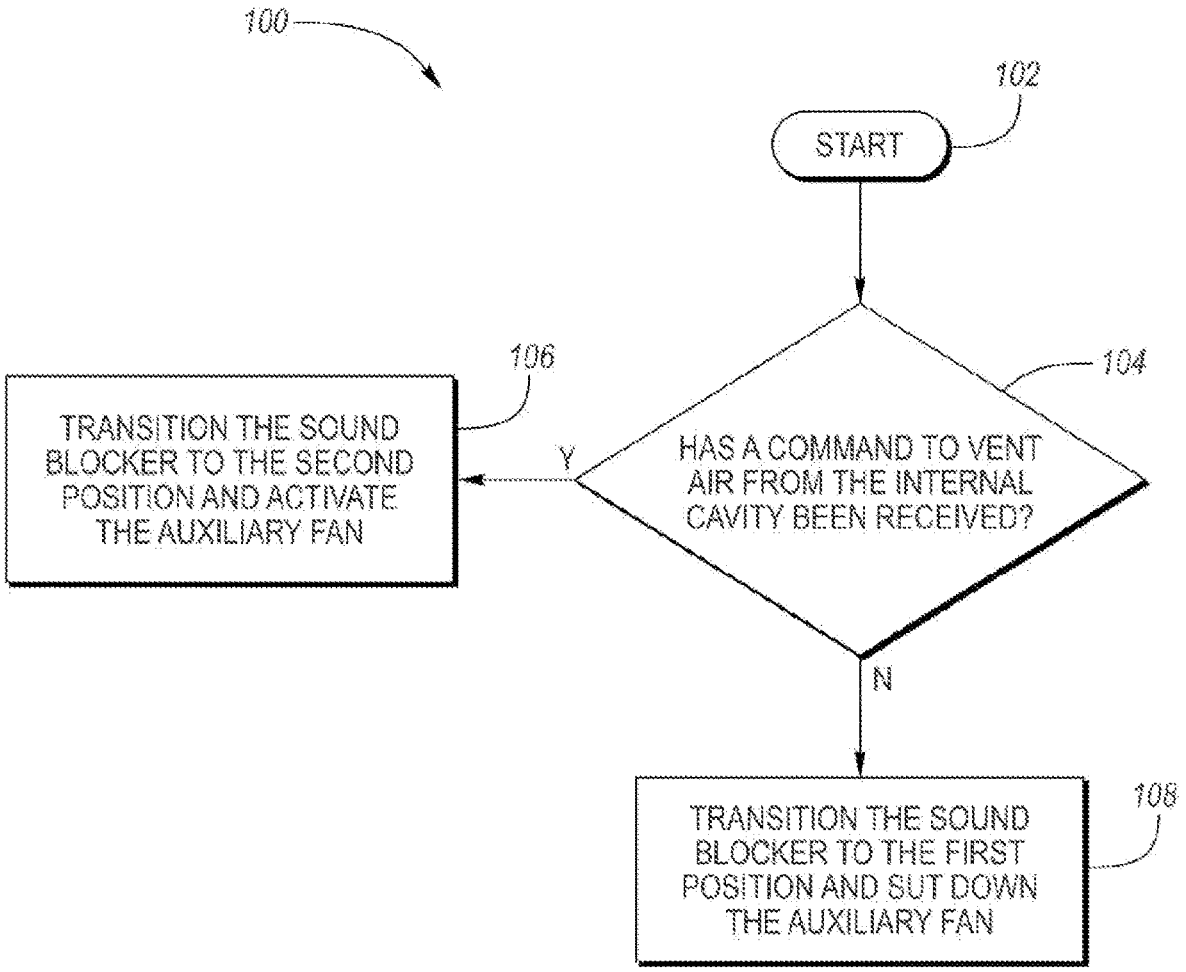
FIG. 6 is a flowchart illustrating a method for controlling the sound blocking device and an auxiliary fan.

Referring to FIG. 6, a flowchart illustrating a method 100 for controlling the sound blocker 46 and the auxiliary fan 44 is illustrated. The method 100 may be implemented by the controller 40. The method 100 may be stored as control logic and/or algorithms within the controller 40. The controller 40 may be configured to control the operation of various components of the appliance 10 (e.g., the actuator 58 to adjust the position of the sound blocker 46 or an electric motor that operates the auxiliary fan 44) in response to various commands received by the controller 40 (e.g., a commend to deliver or exhaust air to or from the internal cavity 32). The method 100 begins at start block 102. The method 100 then moves on to block 104 where it is determined if a command has been received or generated to vent or exhaust air from the internal cavity 32. Alternatively, the command at block 104 may be to deliver air to the internal cavity, depending on the function of the auxiliary fan 44. Either way, air will be directed through the internal cavity 32 whether the auxiliary fan 44 is delivering air to or exhausting air from the internal cavity 32.

If it is determined at block 104 that the command has been received, the method 100 moves on to block 106 where the sound blocker 46 is transitioned to or maintained in the second position 50 and the auxiliary fan 44 is activated or is maintained in an activated or "on" condition. If it is determined at block 104 that the command has not been received (e.g., there is an absence of a command), the method 100 moves on to block 108 where the sound blocker 46 is transitioned to or maintained in the first position 48 and the auxiliary fan 44 is shutdown or is maintained in a shutdown or "off" condition. It should be understood that the flowchart in FIG. 6 is for illustrative purposes only and that the method 100 should not be construed as limited to the flowchart in FIG. 6. Some of the steps of the method 100 may be rearranged while others may be omitted entirely.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A heat-pump type clothes dryer comprising:

a cabinet (i) defining an internal cavity and (ii) having a plurality of outer panels, wherein each outer panel has an inferior surface and an exterior surface, a first of the outer panels defines an orifice, and the orifice establishes fluid communication between the internal cavity and an exterior of the cabinet;

a drum (i) disposed within the internal cavity and (ii) configured to receive clothing articles;

a heat exchanger disposed within the internal cavity and configured heat the internal cavity to dry the clothing articles;

a fan configured to exhaust air from the internal cavity to the exterior of the cabinet via the orifice; and a sound blocking plate (i) disposed within the cavity, (ii) configured to linearly slide between a first position and a second position along the interior surface of the first of the outer panels, and (iii) configured to maintain contact with the interior surface of the first of the outer panels, wherein (a) in the first position the sound blocking plate is disposed over the orifice to obstruct fluid communication between the internal cavity and the exterior of the cabinet and to reduce noise emitted from the internal cavity to the exterior of the cabinet via the orifice, and (b) in the second position the sound blocking plate is retracted away from the orifice to allow fluid communication between the internal cavity and the exterior of the cabinet via the orifice.

2. The beat-pump type clothes dryer of claim 1, wherein the sound blocking plate is adjacent to and not spaced apart from the orifice when in the first position.

3. The heat-pump type clothes dryer of claim 1 further comprising a rail configured to linearly guide the sound blocking plate between the first position and the second position, wherein the rail is secured to the interior surface of the first of the outer panels and spans opposing ends of the orifice.

4. The heat-pump type clothes s dryer of claim 1 further comprising a spring configured to bias the sound blocking plate toward the second position, wherein the spring is anchored to the interior surface of the first of the outer panels.

5. The heat-pump type clothes dryer of claim 1 further comprising an actuator configured to transition the sound blocking plate between the first and second positions, wherein the is anchored to the interior surface of the first of the outer panels.

6. The heat-pump type clothes dryer of claim 5 further comprising a controller programmed to, in response to an absence of a command to vent air from the internal cavity, operate the actuator to transition the sound blocking plate to the first position, and in response to the command to vent air from the internal cavity, operate the actuator to transition the sound blocking plate to the second position.

7. The heat-pump type clothes dryer of claim 1, wherein a sound proofing material is disposed on interior side of the sound blocking plate on an opposing side of the orifice.

8. A clothes dryer comprising:

a housing defining (i) an internal cavity and (ii) having a plurality of outer panels, wherein each outer panel has an interior surface and an exterior surface, and a first of the outer panels defines an orifice;

a fan configured to direct air through the internal cavity; and a sound blocker (i) disposed within the cavity, (ii) configured to linearly slide between a first position and a second position along the interior surface of the first of the outer panels, and (iii) configured to maintain act interior surface of the first of the outer panels, wherein (a) in the first position the sound blocker is disposed over the orifice to obstruct fluid communication between the internal cavity and an exterior of the housing via the orifice and to reduce noise emitted through the orifice, and (b) in the second position the sound blocker is retracted away from the orifice to allow fluid communication between the internal cavity and the exterior of the housing via the orifice.

9. The clothes dryer of claim 8, wherein the sound blocker is adjacent to and not spaced apart from the orifice when in the first position.

10. The clothes dryer of claim 8 further comprising a rail configured to linearly guide the sound blocker between the first position and the second position, wherein the rail is secured to the interior surface of the first of the outer panels and spans opposing ends of the orifice.

11. The clothes dryer of claim 8 further comprising a spring configured to bias the sound blocker toward the second position, wherein the spring is anchored to the interior surface of the first of the outer panels.

12. The clothes dryer of claim 8 further comprising an actuator configured to transition the sound blocker between the first and second positions, wherein the actuator is anchored to the interior surface of the first of the outer panels.

13. The clothes dryer of claim 12 further comprising a controller programmed to, in response to an absence of a command to direct air through the internal cavity, operate the actuator to transition the sound blocker to the first position, and in response to the command to direct air through the internal cavity, operate the actuator to transition the sound blocker to the second position.

14. The clothes dryer of claim 8, wherein a sound proofing material is disposed on interior side of the sound blocker on an opposing side of the orifice.

15. A clothes dryer comprising:

a housing defining an (i) internal cavity and (ii) having a plurality of outer panels, wherein each outer panel has an interior surface and an exterior surface, and a first of the outer panels defines an orifice;

a fan configured to exhaust air from the internal cavity via the orifice;

a plate (i) disposed within the cavity, (ii) configured to linearly slide between a first position and a second position along the interior surface of the first of the outer panels, and (ii) configured to maintain contact with the interior surface of the first of the outer panels, wherein (a) in the first position the plate is disposed over the orifice to obstruct fluid communication between the internal cavity and an exterior of the housing via the orifice and to reduce noise emitted through the orifice, and (b) in the second position the plate is retracted away from the orifice to allow fluid communication between the internal cavity and the exterior of the housing via the orifice; and a controller programmed to, in response to an absence of a command to exhaust air from the internal cavity via the orifice, shutdown the fan and transition the plate to the first position, and in response to the command to exhaust air from the internal cavity via the orifice, activate the fan and transition the plate to the second position.

16. The clothes dryer of claim 15, wherein the plate is adjacent to and not spaced apart from the orifice when in the first position.

17. The clothes dryer of claim 15 further comprising rail configured to linearly guide the plate between the first position and the second position, wherein the rail is secured to the interior surface of the first of the outer panels and spans opposing ends of the orifice.

18. The clothes dryer of claim 15 further comprising a spring configured to bias the plate toward the second position, wherein the spring is anchored to the interior surface of the first of the outer panels.

19. The clothes dryer of claim 15 further comprising an actuator configured to transition the plate between the first and second positions, wherein the actuator is anchored to the interior surface of the first of the outer panels.

20. The clothes dryer of claim 15, wherein a sound proofing material is disposed on interior side of the plate on au opposing side of the orifice.

* * * * *